United States Patent [19]

Weir et al.

[11] 4,429,425

[45] Feb. 7, 1984

[54] SWIMMING POOL COVER OR DOME BEAD CONSTRUCTION

[75] Inventors: Donald H. Weir; Donald E. Dahowski, both of York, Pa.

[73] Assignee: Fox Pool Corporation, York, Pa.

[21] Appl. No.: 404,997

[22] Filed: Aug. 4, 1982

[51] Int. Cl.[3] ..... E04H 3/16; E04H 3/18

[52] U.S. Cl. ..... 4/503; 4/496; 4/498; 4/506

[58] Field of Search ..... 4/503, 506, 496, 498, 4/488

[56] References Cited

U.S. PATENT DOCUMENTS

| | | | |
|---|---|---|---|
| 2,914,776 | 12/1959 | Hotz | 4/503 X |
| 3,177,501 | 4/1965 | Kwake | 4/503 |
| 3,419,916 | 1/1969 | Schankler | 4/506 X |
| 3,628,198 | 12/1971 | Katzman | 4/488 X |
| 3,628,198 | 12/1971 | Katzman | 4/503 |
| 3,667,071 | 6/1972 | Hoch et al. | 4/506 X |
| 4,064,571 | 12/1977 | Phipps | 4/506 X |
| 4,158,244 | 6/1979 | Stefan | 4/506 X |
| 4,182,087 | 1/1980 | Schall et al. | 4/506 X |
| 4,229,844 | 10/1980 | Cribben et al. | 4/506 X |
| 4,335,474 | 6/1982 | Bailey | 4/506 X |

*Primary Examiner*—Henry K. Artis

*Attorney, Agent, or Firm*—Arthur J. Plantamura

[57] ABSTRACT

An improved bead for swimming pool covers or swimming pool domes is provided with locking features which afford substantially improved capability for holding the swimming pool cover or dome secured in a holding groove positioned peripherally around the swimming pool.

The groove into which the bead is positioned may be part of the swimming pool coping that is provided with upper and lower horizontal channels and is secured at the top of the pool wall. Where a coping structure with two bead receiving grooves or channels is used, a pool liner bead is retained in the lower channel and the bead of the cover or dome is retained in the upper channel. Sufficient gripping force by the bead in the coping channel is provided by the bead configuration to prevent dislodging of the bead by forces pulling on the member attached to the bead.

The bead may be used on an existing pool coping which has a channel or groove that can accommodate a cover or dome, or an accessory channel member may be applied which is bolted or otherwise secured to the sidewall at the periphery of the pool below the coping and in which the bead of the cover or dome is secured. Additionally, where a concrete pool is in disrepair, for example, the accessory may be provided with a second channel wherein the lower groove or channel holds the bead of a vinyl liner which covers the concrete bottom of the pool and the upper groove or channel is employed to retain the bead of the cover or dome utilizing the bead construction of the invention.

5 Claims, 7 Drawing Figures

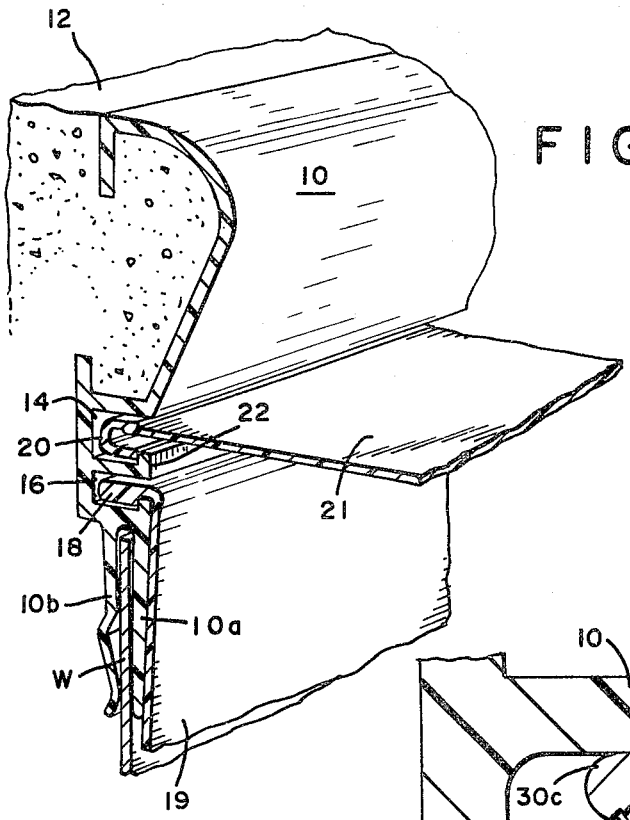
FIG. 1
FIG. 3
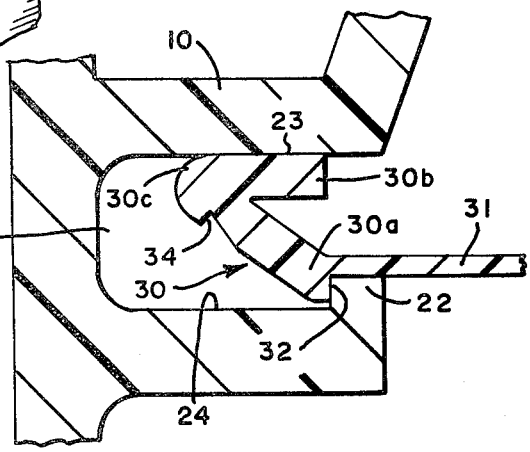
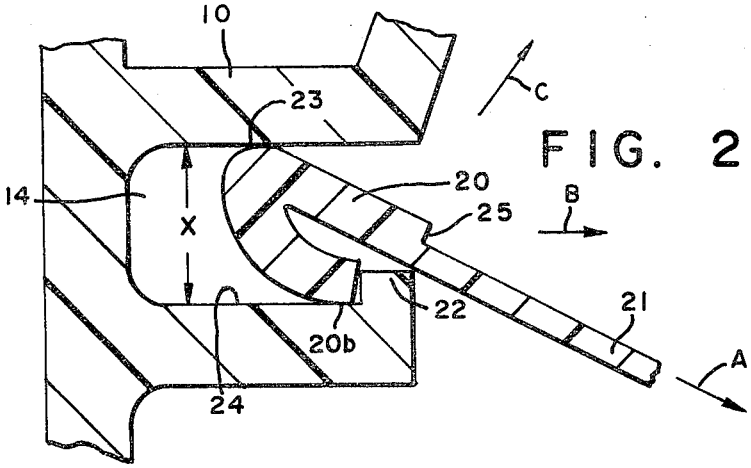
FIG. 2

SWIMMING POOL COVER OR DOME BEAD CONSTRUCTION

This invention relates to a bead construction for a swimming pool cover or dome. The bead comprises improved locking features which enable the bead of the cover or dome to be retained and prevent dislodgment when forces, e.g. wind, rain, debris, etc., tending to pull the bead out of the bead retaining groove channel, are applied.

BACKGROUND OF THE INVENTION

A variety of means for holding covers or domes for swimming pool assemblies are known in the prior art. However, known cover arrangements usually require elaborate, often unsightly, supporting framework or retaining means that are relatively expensive and difficult to put in place and the cover or dome is frequently dislodged when forces are applied. Additionally, most known prior art cover or dome retaining means are either too expensive or cumbersome or do not provide a sufficiently secure fastening means for the cover or dome.

The present invention is directed to an improved swimming pool cover wherein the peripheral bead of a cover or dome is inserted into and locked within a channel or groove which is either integrally formed within the coping or wherein a channel accessory (to secure the bead of the cover or dome) is fastened to the pool sidewall contiguous to and preferably below the coping. The securing means for the cover or dome, by means of the novel retaining bead of the invention, offers sufficient locking retention so that the need for separate support structure or flotation or securing straps or ties is obviated. An important practical advantage resides in the fact that the configuration of the channel in which the bead of the invention is retained need not conform to the contour of the bead configuration.

For the purpose of the invention, the terms "cover" and "dome" as used herein, are interchangeable in that both such members are used to cover the swimming pool although their use differs. In particular, both use the same bead/channel interlocking arrangement which forms the essence of the present invention.

SUMMARY OF THE INVENTION

The objects of the invention reside in providing a novel locking retaining bead which is secured to and holds a swimming pool cover or dome. The bead peripherally formed around the dome or cover is inserted within a longitudinal channel or groove that is usually located below the coping of the swimming pool and receives and retains in place the peripheral bead of the dome or cover. The channel or groove in which the cover is secured may be integrally formed as part of the longitudinal coping element or it may be provided as an elongated accessory which is suitably secured to the pool sidewall just below the coping.

The bead of the invention, which is secured to the peripheral edge of the cover or dome, comprises an elongated hook-like cross section which permits easy horizontal insertion into the retaining channel. However, once inserted, the bead resists forces applied to the dome or cover tending to pull the bead from the holding channel, particularly when forces applied are other than horizontal. The retaining groove or channel is provided with at least one vertical extending tooth-like extension or abutment, contiguous to the opening of the channel, preferably on the lower side of the channel, against which a mating portion of the hook-like shaped bead abuts in locking relationship with the holding groove or channel. The portion of the retaining bead, abutting against the extension formed on the channel member, may comprise the "free" end of the hook-like bead or it may comprise an undercut formed on the "tethered" end of the bead. The tethered end being that portion of the bead which is connected to the cover or dome member.

The coping configuration which may be adapted for use with the present invention may take various forms as described, for example, the copending application of D. H. Weir and D. E. Dahowski, Ser. No. 349,500, filed on Feb. 17, 1982, entitled Swimming Pool Cover Assembly, which is commonly assigned with the present application. For example, the coping may comprise a structure having a vertical downward facing installation groove which receives therein the top of the vertical wall of a prefabricated in-ground swimming pool and is provided with an upper and a lower bead receiving groove or channel. Pools of this kind are formed, conventionally, of a plurality of contiguously joined panels or modules of sheet metal, although such panels may also be formed of other materials such as plastic or fiberglass composition, for example. One coping which accommodates both a liner and a cover simultaneously is provided with a pair of integrally formed horizontally disposed grooves facing the interior of the pool. The lower horizontal groove receives the peripheral bead of a flexible swimming pool liner while the upper horizontal groove receives therein the bead of a swimming pool cover or dome. The hook-like configuration of the peripheral bead, which is an extension of the cover or dome, in accordance with the invention retains the cover or dome bead securely locked within the coping groove or channel. No additional fastening means such as screws, bolts, clamps, etc. is required to secure the cover or dome. In the fabrication of swimming pools, one common means of additionally securing the coping includes flowing concrete into the back of the coping at the time the swimming pool deck is installed. In such coping structures, the side of the coping facing the outside of the pool, contiguous to the top of the coping, is open to allow concrete to flow therein. The concrete also forms the deck around the pool. This integral arrangement more securely retains the coping in position.

When an existing pool is to be equipped with the cover securing means of the invention, a longitudinal accessory having formed therein at least one bead locking channel is secured to the pool periphery, preferably at the pool side wall just below the coping. An arrangement of this kind is described in more detail in the above-mentioned copending patent application, U.S. Ser. No. 349500.

BRIEF DESCRIPTION OF THE DRAWING

The invention will be more fully understood from the following detailed description in conjunction with the several illustrative figures of the accompanying drawing in which:

FIG. 1 is a perspective view, partly in section, of a fragmentary portion of a swimming pool coping and deck to illustrate the attachment of the pool cover or dome bead, of the present invention, in a retaining groove or channel.

FIG. 2 is an enlarged cross sectional view of the bead shown in FIG. 1 illustrating the action of the pool cover bead in the coping channel when a generally downward tensile force is applied to a cover or dome which is attached to the bead.

FIG. 3 is a cross sectional view similar to FIG. 2 showing an alternate bead design.

DETAILED DESCRIPTION OF THE INVENTION

Figure 5:
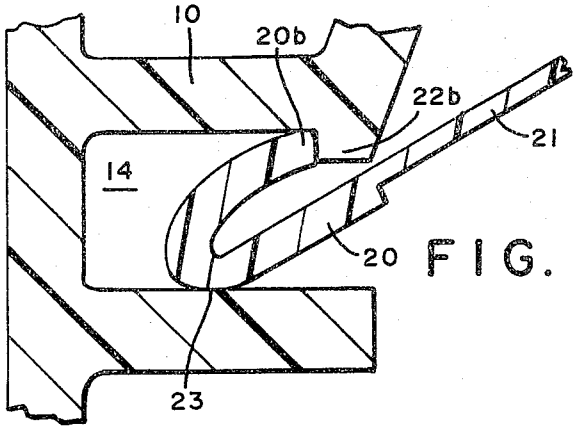
FIG. 5 is an enlarged cross sectional view showing the construction of the coping channel in which the bead retaining tooth-like extension, contiguous to the channel and against which the cooperating part of the bead abuts, is formed at the top.

Reference is made to FIG. 1 of the drawing which illustrates a fragment of a swimming pool coping 10 embedded in a poured concrete deck 12 which surrounds the top of the pool. The lower portion of the coping 10 is formed with a horizontally extending upper channel 14 and an adjacent lower channel 16. The coping 10 is conveniently positioned on the top of the swimming pool wall W which is straddled by the bifurcated lower portion of the coping 10 comprising the inner leg 10*a* and outer leg 10*b*. A liner bead 18 serves to secure a pool liner 19 in place when the bead as shown is installed in the lower channel 16. The upper channel 14 is designed to receve a bead 20 having a configuration in accordance with the present invention. The bead 20 held in groove 14 retains a pool cover (or dome) 21 in a manner to secure the cover (or dome) in place.

The upper channel 14 comprises a recess with a lateral dimension larger than the vertical dimension and is generally of a U-shaped configuration in cross section. It will be noted that the channel or groove 14 conveniently does not and need not conform to the shape of the bead 20. The bead 20 which has a hook-like cross sectional configuration, is secured at the periphery, and forms an integral part, of the cover 21 to which it is attached. The lower end 20*b* of the hook-like bead 20 is designed to abut against the vertical extension or lip 22 formed along the lower end of, and contiguous to, the opening of the channel 14 to secure the cover bead 20 in place. The channel 14 is designed as having a suitable dimension X, relative to the transverse dimension of the bead 20 so that when a dislodging force, indicated as being downardly by arrow A (FIG. 2); or outwardly substantially horizontally as shown by arrow B; or upwardly as in the case of an air inflated dome, as indicated by arrow C; the bead 20 becomes wedged against the lip 22 and between the top and bottom 23 and 24 of the channel or groove 14 to secure the cover bead 20 against being dislodged from the groove 14. One advantageous bead design comprises a cross section having at least one arcuate side as shown by the bottom portion of the bead of FIGS. 1 and 2.

The bead 20 is preferably formed of a semi-rigid plastic, i.e. synthetic resin composition, such as a nylon, polyvinyl chloride, polyester, polycarbonate, polyolefin, e.g. polypropylene or polyethylene, and the like, and is sufficiently thick in cross section to withstand substantial stress and deformation without yielding. Moreover, the bead, which is preferably elongated in a horizontal direction, is sized so that, while readily insertable into the channel member when disposed horizontally, the bead's transverse dimension extends substantially across the entire vertical distance X of the channel 14 and the bead cannot be rotated without binding in the channel 14.

Figure 7:
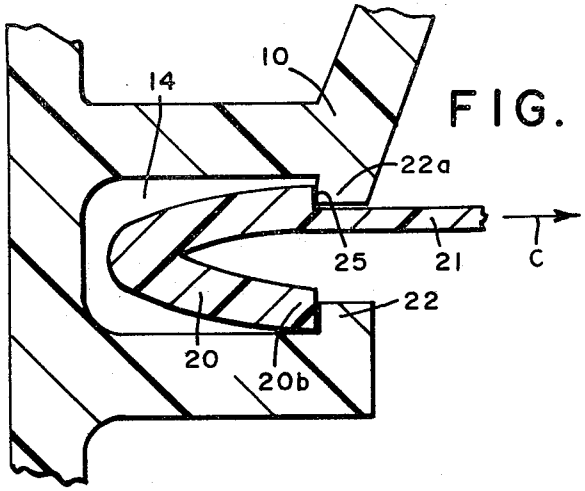
FIG. 7 is a cross sectional view of an alternate channel configuration, with retaining bead, wherein the channel is provided with a tooth-like vertical bead retaining extension contiguous to the opening of the channel at the top as well as at the bottom.

To further enhance the retaining power of the bead 20, a notch 25 is formed at the point of junction of the bead and the cover 21. Although only a single abutting extension on the channel 14 is required, as shown in FIG. 7, an upper extension 22*a* (see FIG. 7) contiguous to the channel opening may be provided against which the notch 25 abuts.

Figure 4:
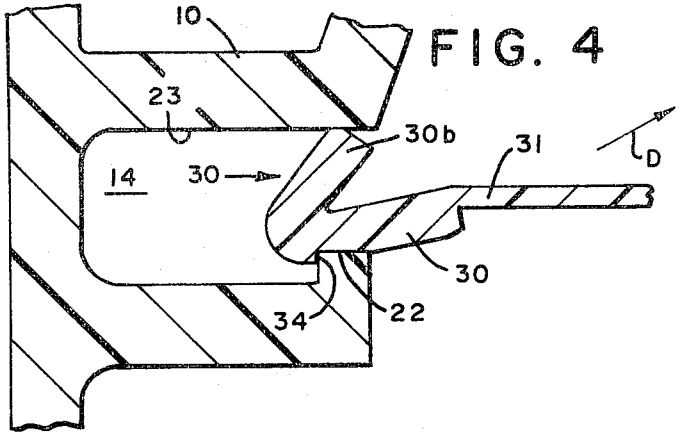
FIG. 4 is a view of the embodiment of FIG. 3 showing the retaining function of that bead design when a generally upward tensile force is applied on the cover or dome.

An alternate design of pool cover bead is illustrated by FIGS. 3 and 4 wherein the configuration of the hook-like bead 30 is substantially more of a V-shaped rather than C-shaped as in FIG. 2. The bead 30 inserted into the channel 14 is comprised of a free end 30*b* at the top and a pair of abutting notches 32 and 34, which function in sequence, at the bottom. The tethered part of the bead 30, i.e. the lower end 30*a* of the bead 30, is attached to the cover 31 and has a notch 32 substantially at the connecting point of the bead and the cover 31. Notch 32 abuts against the lip 22 of the channel 14 and when tensile forces are applied upwardly or downwardly on cover 31 the upper free end 30*b* of the bead or bead end 30*c* respectively becomes wedged against the upper side 23 of the channel 14 increasing resistance against dislodgement of the bead 30 from the channel.

To provide further assurance against dislodgment as when there is a sudden tensile force applied in the upward direction, a secondary notch 34 is formed in the lower side 30*a* of the bead 30. Thus, should the notch 32 become dislodged from its abutment against the groove lip 22 due to a force indicated by arrow D (FIG. 4) the secondary notch 34 will abut the lip 22 as the upper free end 30*b* of the hook-like bead will become wedged with relatively greater pressure against the upper side 23 of the channel 14 thereby preventing dislodgment of the bead 30 from channel 14.

In the embodiment illustrated in FIG. 5, a bead configuration substantially similar to that of FIG. 2 is illustrated. However, in FIG. 5, the cover 21 is secured to the bottom side of the hook-like bead 20 with the free end 20*b* of the bead at the top. Additionally, FIG. 5 differs in that the vertical extension 22*b* contiguous to the opening of the channel 14 depends from the top rather than from the bottom as in FIG. 2. The bead functions similarly in its locking capability, resisting dislodgment as forces are applied in either upward, horizontal or downward directions. In the horizontal direction, the rigidity of the bead itself fills the vertical dimension and the abutment of the free end of the bead 20*b* against the depending abutment or lip 22*b* on the groove 14 presents dislodgment of the bead. In the upward direction (as shown in FIG. 5) the heel of the bead exerting pressure at 23 binds the bead 20 with increasing resistance in channel 14. Similarly, when the tensile force from the cover 21 is in the downward direction, the rigidity of the bead 20 and the increasing force applied at the bottom of the channel opening and, at the same time, at the point of abutment of the free end 20*b* of the bead 20 with the depending extension or lip 22*b*, increasing resistance is applied against the bead 20 being dislodged from the channel 14.

Figure 6:
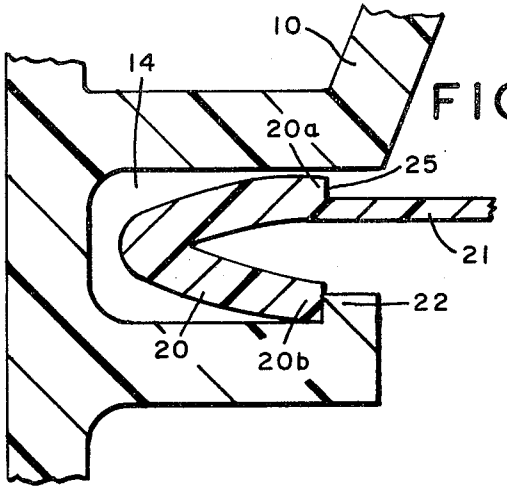
FIG. 6 is a cross sectional view of still another alternate form of bead configuration.

In the alternate embodiment illustrated in FIG. 6, a bead having a generally symmetrical oval-shaped bead 20 having top part 20*a* tethered to the cover 21 and a lower free end 20*b* which abuts against the vertical extension or lip 22 contiguous to the opening of the groove 14 in the coping member 10. The locking mechanism of the bead of FIG. 6 functions in a manner similar to that described with reference to the bead described in FIG. 2.

The embodiment illustrated in FIG. 7 differs from that in FIG. 6 in that a second depending optional extension 22*a* may be utilized in addition to the upward extension 22 contiguous to the opening of channel 14. In FIG. 7 the free end 20*b* of the hook-shaped bed 20 abuts against the upward extending element 22 and undercut 25, formed on the opposite side of the bead 20, abuts against the depending extension 22*a*.

In each of the foregoing, it is seen that it is not necessary to contour the cross section of the bead receiving channel or groove to conform to the cross section of the bead. It is only necessary that the bead have a sufficient length to prevent rotation of the bead in the receiving groove or channel.

While the preferred embodiments of the invention have been disclosed in detail, it is to be understood that various alternative details or equivalents which fall within the scope of the invention as claimed may be adapted by those skilled in the art.

What is claimed is:

1. In combination, a swimming pool cover provided with a peripheral bead to hold said cover in position, said bead being adapted to be inserted into a longitudinal bead holding channel member said channel member being open in the direction facing the pool and being provided with at least one vertical retaining lip contiguous to the channel opening to engage a mating face on said bead, said channel member being positioned contiguous to the swimming pool coping, and said bead characterized in having:

(a) a cross section resembling a hook-like configuration which is insertable horizontally into said channel, (b) a transverse dimension which extends substantially across the entire vertical dimension of said channel, (c) the free end of said hook-like configuration abutting against the vertical retaining lip of said channel, and (d) having a longitudinal dimension which increasingly resists withdrawal of the bead from the channel as the bead is rotated from a horizontal position.

2. The combination of claim 1 wherein said hook-like bead is provided with an undercut opposite the free end and on the outside of the bead and wherein said undercut rather than said free end of the bead abuts against the vertical retaining lip of said channel.

3. The combination of claim 1 wherein said hook-like bead is provided with a pair of undercuts wherein the second of said undercuts engages said vertical retaining lip in sequence in the event of disengagement with the vertical retaining lip of the first undercut.

4. The combination of claim 2 wherein said channel member is provided with a retaining lip at the top and bottom of said channel contiguous to the channel opening and wherein the free end of said hook-like bead engages one lip and the undercut engages the other lip.

5. The combination of claim 1 wherein said bead is further characterized as having in cross section at least one arcuate side.

* * * * *